United States Patent [19]

Guidosh

[11] 4,013,847

[45] Mar. 22, 1977

[54] NO-LOAD TAP CHANGER SWITCH WITH RACK AND PINION GEAR OPERATING MECHANISM

[75] Inventor: Edward F. Guidosh, Coitsville Township, Ohio

[73] Assignee: Westinghouse Electric Corporation, Pittsburgh, Pa.

[22] Filed: July 24, 1975

[21] Appl. No.: 599,241

[52] U.S. Cl. ..... 200/18; 200/11 TC; 200/153 P

[51] Int. Cl.[2] ..... H01H 3/00; H01H 19/54

[58] Field of Search ..... 200/11 R, 11 D, 11 DA, 200/11 TC, 14, 17 R, 18, 153 P

[56] References Cited

UNITED STATES PATENTS

| | | | |
|---|---|---|---|
| 2,177,109 | 10/1939 | Hill | 200/11 TC UX |
| 2,980,901 | 4/1961 | Morris et al. | 200/18 X |
| 3,155,782 | 11/1964 | Wilson, Jr. | 200/11 TC |
| 3,396,248 | 8/1968 | Wilson, Jr. | 200/11 TC |

*Primary Examiner*—James R. Scott
*Attorney, Agent, or Firm*—C. L. McHale

[57] ABSTRACT

Tap changing apparatus for connection to the windings of a three-phase power transformer. The tap changer includes a mounting board on which three sets of stationary contacts, arranged in a circular pattern, are mounted. A rotating contact assembly is associated with each set of stationary contacts and may be pivoted around the center of the stationary contact set for engagement with one of the stationary contacts. An operating bar extends across each set of stationary contacts and is coupled to the rotating contacts by rack and pinion assemblies. When the operating bar is moved in one direction, the rotating contacts are turned in a counterclockwise direction. When the operating bar is moved in the other direction, the rotating contacts are turned in the clockwise direction. The operating bar is moved by a rack and pinion assembly which is connected to a rotating shaft.

2 Claims, 5 Drawing Figures

NO-LOAD TAP CHANGER SWITCH WITH RACK AND PINION GEAR OPERATING MECHANISM

BACKGROUND OF THE INVENTION

1. Field of the Invention

This invention relates, in general to electrical apparatus and, more specifically, to tap changers for power transformers.

2. Description of the Prior Art

No-load tap changers are used with power transformers to effectively change the turns ratio between the primary and secondary windings of the transformers. Conventional no-load tap changers for power transformers usually include a plurality of stationary contact structures and a movable contact assembly which may be moved into engagement with one of the stationary contacts. The stationary contacts are connected to taps on the transformer winding and the movable contact is connected to another portion of the winding or to the load associated with the transformer.

No-load tap changers for three-phase power transformers usually have separate sets of stationary and movable contacts for each winding phase. These contacts are usually connected together by a common shaft so that they may be changed simultaneously. One type of conventional arrangement used in the prior art has three sets of stationary contacts disposed in a circular arrangement around a common axis. Rotating contacts associated with these stationary contacts are positioned and adapted for rotation around the common axis to make electrical connection with one of the stationary contacts. The rotating contacts are mechanically connected to each other by a series of shafts which extend along the common axis. Thus, the tap changer has one axis of rotation and three planes which generally contain the stationary contacts of the tap changer.

Tap changing apparatus constructed according to this prior art arrangement is satisfactory but requires elaborate coupling mechanisms between each phase of the tap changer and occupies considerable space within the transformer enclosure. Therefore, it is desirable, and it is an object of this invention, to provide a three-phase no-load tap changer for power transformers which may be economically constructed and which occupies less space in the transformer enclosure than prior art no-load tap changers.

SUMMARY OF THE INVENTION

There is disclosed herein a new and useful arrangement for a no-load tap changer suitable for use with three-phase power transformers. The tap changer includes a rectangular shaped mounting board constructed of an insulating material. Along the mounting board are positioned three sets of stationary contacts which are arranged in a circular pattern around three separate axes. A rotating contact assembly is associated with each set of stationary contacts and is rotatable around the respective axis of the stationary contact set. An operating bar is positioned across the three sets of stationary contacts and is coupled to the rotating contacts by rack and pinion assemblies. When the operating rod is moved in one linear direction, the pinion gears rotate to turn the rotating contacts associated therewith in a counterclockwise direction. When the operating rod moves in the opposite linear direction, the rotating contacts turn in the clockwise direction.

Movement of the operating rod is controlled by another rack and pinion assembly which is connected to the operating bar and to a rotatable shaft which is coupled to a crank handle located on the outside of the transformer enclosure.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
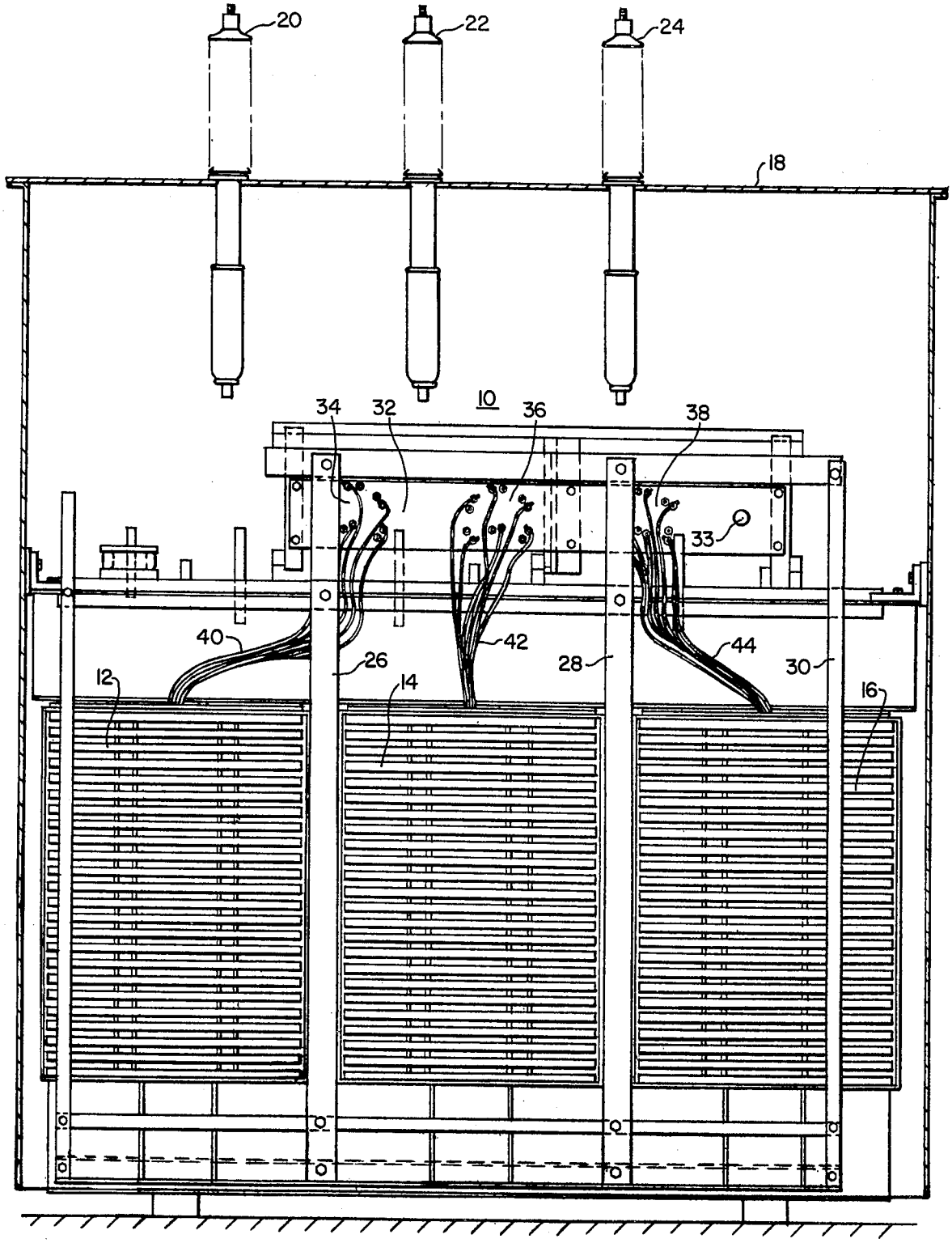
FIG. 1 is an elevational view of a power transformer having a three-phase tap changer enclosed within the transformer tank.

Throughout the following description, similar reference characters refer to similar elements or members in all of the figures of the drawing.

Referring now to the drawing, and to FIG. 1 in particular, there is shown a three-phase power transformer which includes a tap changer 10 constructed according to this invention. The transformer includes the phase windings 12, 14 and 16 which are located around legs of a three-phase magnetic core. The tank or enclosure 18 surrounds the transformer core and coil assembly and the tap changer 10. The tank also supports the bushings 20, 22 and 24 which, although not shown, would normally be connected to leads extending into the transformer windings.

The tap changer 10 is supported above the transformer core and coil assembly with the aid of supporting brackets 26, 28 and 30. The tap changer 10 includes a rectangular mounting board 32 on which the contact sets 34, 36 and 38, which are associated with each phase of the transformer winding, are attached. The tap leads 40, 42 and 44 are connected to the appropriate contact set conveniently as shown in FIG. 1 since the tap leads do not have to be bent around the moving portions of the tap changer as was necessary with prior art tap changers. The shaft 33 extends from the mounting board 32 and, although not illustrated, would be attached to an operating handle located on the outside of the tank 18. Turning the operating handle would appropriately move the components of the tap changer 10 to change the tap position on the phase windings 12, 14 and 16.

Figure 2:
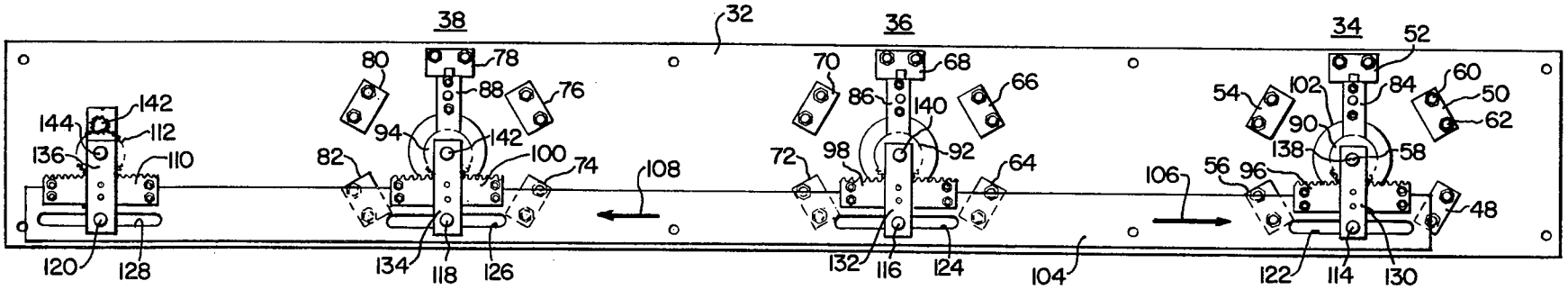
FIG. 2 is a side view of the tap changer shown in FIG. 1.

FIG. 2 is a side view of the tap changer 10 illustrated in FIG. 1. The side ilustrated in FIG. 2 is opposite to the side illustrated in FIG. 1. The mounting board 32 is constructed of an insulating material, such as a laminated material sold commercially under the trademark "Micarta." The contact set 34 includes the stationary contacts 48, 50, 52, 54 and 56 which are aligned in a circular or arc pattern around a pivot location through which the axis of rotation 58 extends. Each stationary contact is attached to the mounting board 32 by appropriate fastening means, such as the bolts 60 and 62 of the contact 50. The stationary contacts 64, 66, 68, 70 and 72 of the contact set 36 and the stationary contacts 74, 76, 78, 80 and 82 of the contact set 38 are similarly constructed and attached.

Rotating contact assemblies 84, 86 and 88 are connected through the pinion gears 90, 92 and 94 to the rack gears 96, 98 and 100, all respectively. Each of the rotating contact assemblies 84, 86 and 88 includes a movable portion which is rotatable for engagement with any of the stationary contacts and a fixed contact portion, such as the contact portion 102, with which the rotating contact is always engaged.

The operating rod or bar 104 extends across each contact set and is substantially perpendicular to the axes of rotation of the movable or rotating contact assemblies. Although other materials may be used within the scope of this invention, in the preferred embodiment described herein the operating rod is constructed of an insulating material. The rack gears 96, 98 and 100 are attached to the operating bar 104 and are moved with a movement of the operating bar. When the operating bar 104 is moved in the direction indicated by the arrow 106, the rotating contact assemblies are rotated in a counterclockwise direction according to the orientation of the view shown in FIG. 2. Similarly, when the operating bar 104 moves in the direction indicated by the arrow 108, the rotating contact assemblies rotate in the clockwise direction.

The operating bar 104 extends beyond the stationary contact sets and is connected by the rack gear 110 and the pinion gear 112 to the portion 142 of the shaft 33. The portion 142 contains teeth which mesh with the teeth on the pinion gear 112 so that rotation of the shaft 33 from outside the transformer enclosure rotates the pinion gear 112. This moves the operating bar 104 in a linear direction corresponding to the rotational direction in which the shaft 33 is turned.

Figure 3:
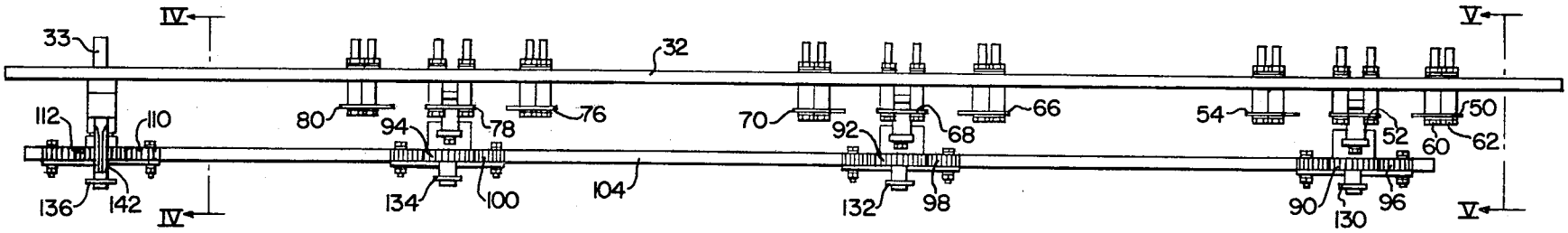
FIG. 3 is a top view of the tap changer shown in FIGS. 1 and 2.

FIG. 3 is a top view of the tap changer shown in FIG. 2 illustrating other details of the construction thereof. By referring to FIGS. 2 and 3, it can be seen that the operating bar 104 is spaced from the mounting board 32 sufficiently to clear the stationary contact sets. As shown in FIG. 2, guide pins 114, 116, 118 and 120 extend through slots 122, 124, 126 and 128 in the operating bar 104. The guide pins and the slots cooperate to maintain engagement of the rack gears attached to the operating bar 104 with the pinion gears which are attached to the rotating contact assemblies and coupled to the operating shaft 33. Although not shown, suitable means such as slots in the guide pins are used to maintain the spacing between the mounting board 32 and the operating bar 104. The reinforcing bars 130, 132, 134 and 136 are attached between the guide pins and the shafts 138, 140, 142 and 144 on which the pinion gears are mounted.

As shown in FIG. 3, the stationary contacts are attached to the mounting board 32 by bolts and studs to which the electrical leads of a tapped winding may be connected. The rotating contact assemblies include contact fingers which engage with the conducting blades which form the stationary contacts. These fingers also engage a stationary contact located around the axis of rotation of the rotating contact assembly. Some of the stationary contacts are not illustrated in FIG. 3 in the interest of clarity.

Figure 4:
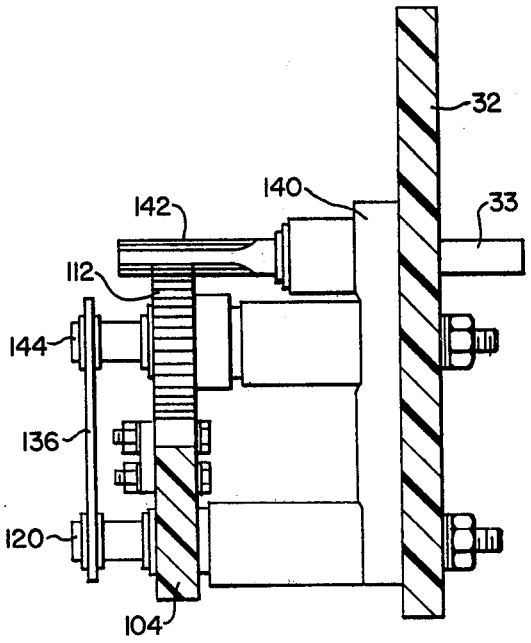
FIG. 4 is a cross-sectional view taken generally along the line IV—IV of FIG. 3.

FIG. 4 is a cross-sectional view taken generally along the lines IV—IV of FIG. 3. FIG. 4 illustrates in detail the construction of the portion of the tap changer 10 which is used to initially move the operating rod or bar 104. The shaft 33 extends through the mounting board 32 and through the mounting collar 140 which is attached to the mounting board 32. The teeth on the portion 142 of the shaft 33 mesh with the teeth on the pinion gear 112, thereby rotating the pinion 112 when the shaft 33 is rotated from an external source. When the pinion 112 is rotated, the operating bar 104 is moved in a linear direction according to the direction of rotation of the pinion 112.

Figure 5:
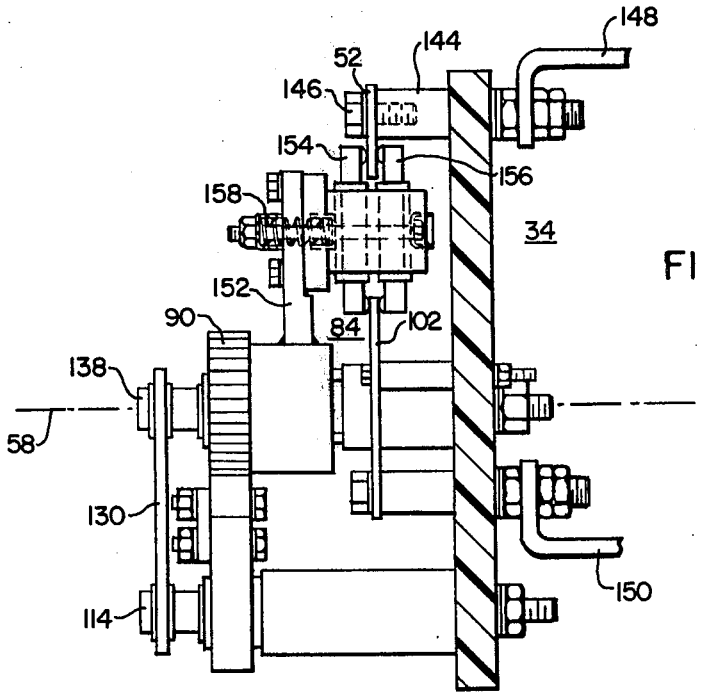
FIG. 5 is a cross-sectional view taken generally along the line V—V of FIG. 3.

FIG. 5 is a cross-sectional view taken generally along the line V—V of FIG. 3. FIG. 5 illustrates in detail the construction of the contact structures associated with the phase contact set 34 which is located at one end of the tap changer 10. Although FIG. 5 illustrates only one phase of the tap changer 10, the other two phases of the tap changer are constructed identically. In addition, some of the stationary contacts are not illustrated in FIG. 5 in the interest of clarity.

The blade or stationary contact 52 is separated from the mounting board 32 by the stud 144 into which the bolt 146 extends. Electrical connection of the tap lead 148 is provided by attaching the lead 148 to the stud 144 which is in contact with the stationary contact 52. The tap lead 150 is similarly connected to the blade or fixed contact portion 102 of the rotating contact assembly 84.

A contact carrier 152 is attached to the pinion 90 and supports a suitable conducting structure which connects the stationary contacts 52 and 102 together when in the position shown in FIG. 5. This contact structure includes the contact fingers 154 and 156 which are resiliently forced together by the spring 158 to make good electrical connection with the stationary contact blades.

The tap changer disclosed herein contains contact structures which are oriented and interconnected in such a manner that simplicity of operation and a reduction in required space may be achieved over prior art no-load tap changers. Since numerous changes may be made in the above described apparatus, and since different embodiments of the invention may be made without departing from the spirit thereof, it is intended that all of the matter contained in the foregoing description, or shown in the accompanying drawing, shall be interpreted as illustrative rather than limiting.

I claim as my invention:

1. Tap changer apparatus comprising:

a tank, first, second and third winding phases disposed in said tank, said winding phases each having tapped winding sections with tap leads connected thereto, said winding phases being horizontally spaced in said tank with their longitudinal axes in a common plane, an elongated insulating member disposed in said tank with its longitudinal axis substantially parallel to said common plane, first, second and third contact sets mounted in horizontally spaced relation from one another on said elongated insulating member, each of said contact sets including a plurality of stationary electrical contacts positioned in an arc pattern around and equidistant from an axis of rotation, first, second and third rotatable contacts pivotably mounted from a first side of said elongated insulating member on the axes of said first, second and third contact sets, respectively, for selective engagement with the associated stationary electrical contacts, said tap leads from the first, second and third winding phases being connected to the first, second and third contact sets and their associated rotatable contacts, respectively, an elongated operating member mounted for linear movement on a common side of said insulating member, first, second and third coupling means operatively connected between said elongated operating member and said first, second and third rotatable contacts, respectively, said first, second and third coupling means translating linear movement of said elongated operating member to rotary movement of said first, second and third rotatable contacts, respectively, and rotary operating means operable from outside of said tank, said rotary operating means including fourth coupling means operably connected to said elongated operating member for translating rotary movement of said rotary operating means to linear movement of said elongated operating member.

2. The tap changer apparatus of claim 1 wherein the first, second, third and fourth coupling means each include a rack gear and associated pinion gear, with the rack gears being mounted on the elongated operating member, and with the pinion gears being rotatably mounted on the elongated insulating member with their rotational axes in spaced parallel relation.

* * * * *